US006681532B1

(12) United States Patent
Palmbos et al.

(10) Patent No.: US 6,681,532 B1
(45) Date of Patent: Jan. 27, 2004

(54) MODULAR BI-FOLD DOOR

(75) Inventors: Allen Lee Palmbos, Jenison, MI (US); Mark Joseph Consolla, Grand Rapids, MI (US); P. Ramsey Madsen, Aliso Viejo, CA (US); William J. Pokletar, Mission Viejo, CA (US)

(73) Assignee: Knoll, Inc., East Greenville, PA (US)

( * ) Notice: Subject to any disclaimer, the term of this patent is extended or adjusted under 35 U.S.C. 154(b) by 0 days.

(21) Appl. No.: 10/160,342

(22) Filed: May 31, 2002

(51) Int. Cl.[7] ..... E04B 1/346; E04B 7/16

(52) U.S. Cl. ..... 52/71; 52/36.1; 160/135; 160/351; 49/501; 49/70; 49/98

(58) Field of Search ..... 52/71, 36.1; 160/135, 160/351; 49/501, 70, 98

(56) References Cited

U.S. PATENT DOCUMENTS

| | | | | | |
|---|---|---|---|---|---|
| 3,466,777 | A | * | 9/1969 | Wistrand et al. | 40/605 |
| 3,498,011 | A | * | 3/1970 | Lindgren | 52/31 |
| 3,762,116 | A | | 10/1973 | Anderson et al. | |
| 3,877,191 | A | | 4/1975 | Munsey | |
| 4,870,908 | A | | 10/1989 | Wolters et al. | |
| 4,932,172 | A | | 6/1990 | Maas | |
| 5,025,846 | A | | 6/1991 | West | |
| 5,214,885 | A | * | 6/1993 | Maas et al. | 52/71 |
| 5,282,341 | A | | 2/1994 | Baloga et al. | |
| 5,282,606 | A | | 2/1994 | Praiss | |
| 5,287,909 | A | * | 2/1994 | King et al. | 160/135 |
| 5,295,527 | A | | 3/1994 | West | |
| 5,452,547 | A | | 9/1995 | Baloga et al. | |
| 5,592,787 | A | | 1/1997 | Ophardt | |
| 5,651,219 | A | | 7/1997 | Baloga et al. | |
| 5,687,513 | A | | 11/1997 | Baloga et al. | |
| 5,829,202 | A | | 11/1998 | Canton Gongora et al. | |
| 5,921,040 | A | | 7/1999 | Glashouwer et al. | |
| 6,009,930 | A | | 1/2000 | Jantschek | |
| 6,233,879 | B1 | | 5/2001 | Barbeau | |
| 6,493,995 | B2 | * | 12/2002 | McKenzie | 52/36.4 |

* cited by examiner

*Primary Examiner*—Carl D. Friedman
*Assistant Examiner*—Nahid Amiri
(74) *Attorney, Agent, or Firm*—Buchanan Ingersoll

(57) ABSTRACT

The present invention is a door adaptable for work spaces in a modular work area environment. The door is bi-fold in design, can be attached to any flat surface, and is particularly suited for attachment to the flat end portion of the modular wall separating two adjacent modular work spaces. The door can then be used to close the entry and egress area of either adjacent modular work space areas. When not in use, the door can be folded such that it rests in a position perpendicular to the shared modular wall, such that the entry and egress areas of both adjacent modular work spaces are open.

24 Claims, 13 Drawing Sheets

MODULAR BI-FOLD DOOR

FIELD OF THE INVENTION

This invention relates to modular work spaces and, in particular, to devices for providing privacy to single work spaces, in a modular work space environment.

BACKGROUND OF THE INVENTION

Modular work spaces, or "cubicles," are well known in the art. In general the modular work space allows the transformation of a wide open area into an office area having multiple work spaces for multiple workers. In general, a modular work area consists of wall panels which can be connected together in various ways to form individual work spaces. Generally, the modular work space includes modules which provide typical office accessories, such as desks and cabinets and typically also includes conduits for the routing of electrical and communication wiring. Entry to and egress from individual modular work spaces generally is provided by means of a gap in the modular work space, wherein the series of modular walls does not comprise a completely enclosed space. Generally the modular work spaces do not have doors, although it is possible to utilize a traditional door in the open entry and egress area of the modular work space.

While the modular work space provides an open working atmosphere, it is often desirable to have privacy in individual areas during certain activities, such as when conducting meetings in the work spaces or while communicating on the phone, to avoid disturbing others and to provide a certain amount of privacy for the person in the work place. Therefore, it would be desirable to provide a door that provides temporary privacy within the modular work space while not destroying the open atmosphere of the overall work plan area.

SUMMARY OF THE INVENTION

The present invention provides a door for a modular work space unit and, in particular, a bi-fold door that can be shared between two adjacent modular work spaces. The door comprises a main panel having casters on the bottom thereof to facilitate its movement across a hard or carpeted floor, and a second panel hingedly attached to the main panel that provides an attachment to the existing modular work space area. The door of the present invention is designed to be adaptable to existing modular work areas that have a wall having a flat end section adjacent to the entry and egress area of the individual work space, or between two adjacent work space areas. Alternatively, the door of the present invention could also be used on any flat surface, such as a wall. The door has an attachment point which can be attached to any flat surface via any number of ordinary connection means, such as with screws.

The door, when attached to the flat end of a modular wall separating two adjacent work areas, is designed to swing either to the left or to the right to enclose the entry and egress area of either of the two adjacent work areas. When not in use, the door is designed to fold up somewhat perpendicular to the wall between the two adjacent work stations.

DETAILED DESCRIPTION OF THE INVENTION

Figure 1:
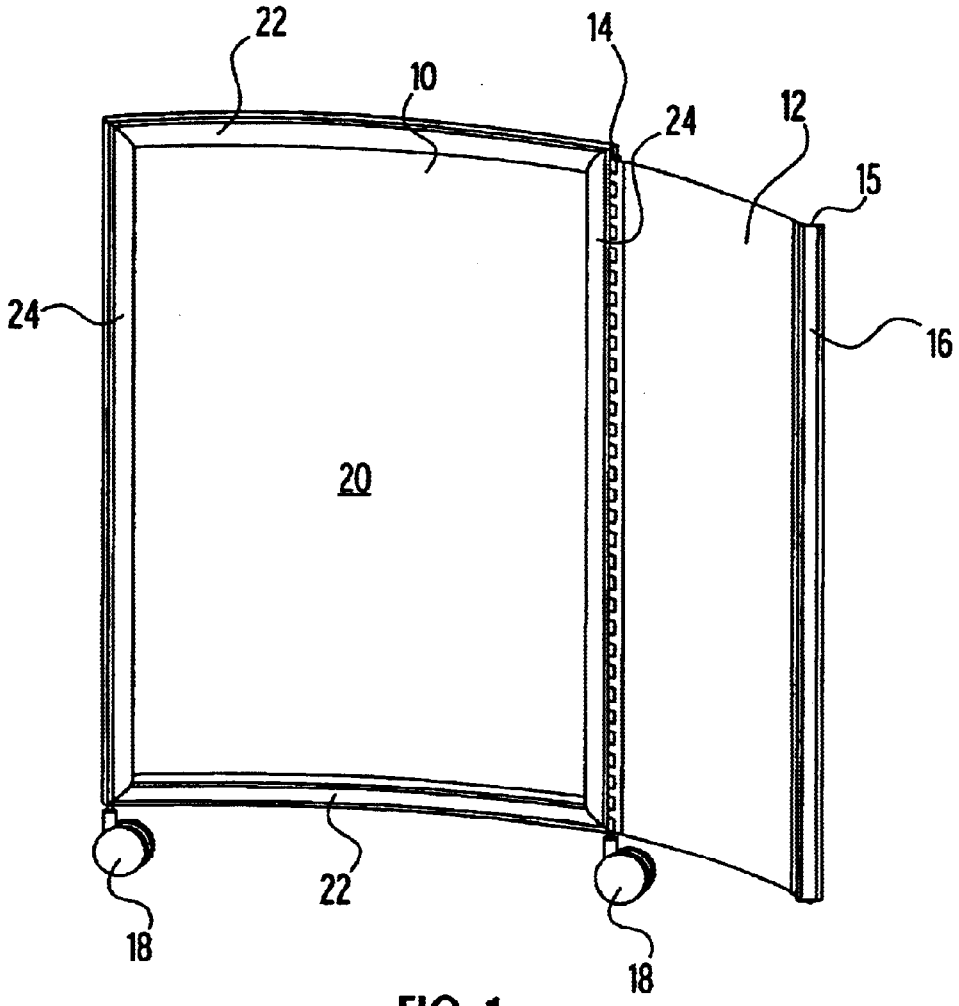
FIG. 1 shows a plan view of the door showing the component parts thereof.
Figure 3A:
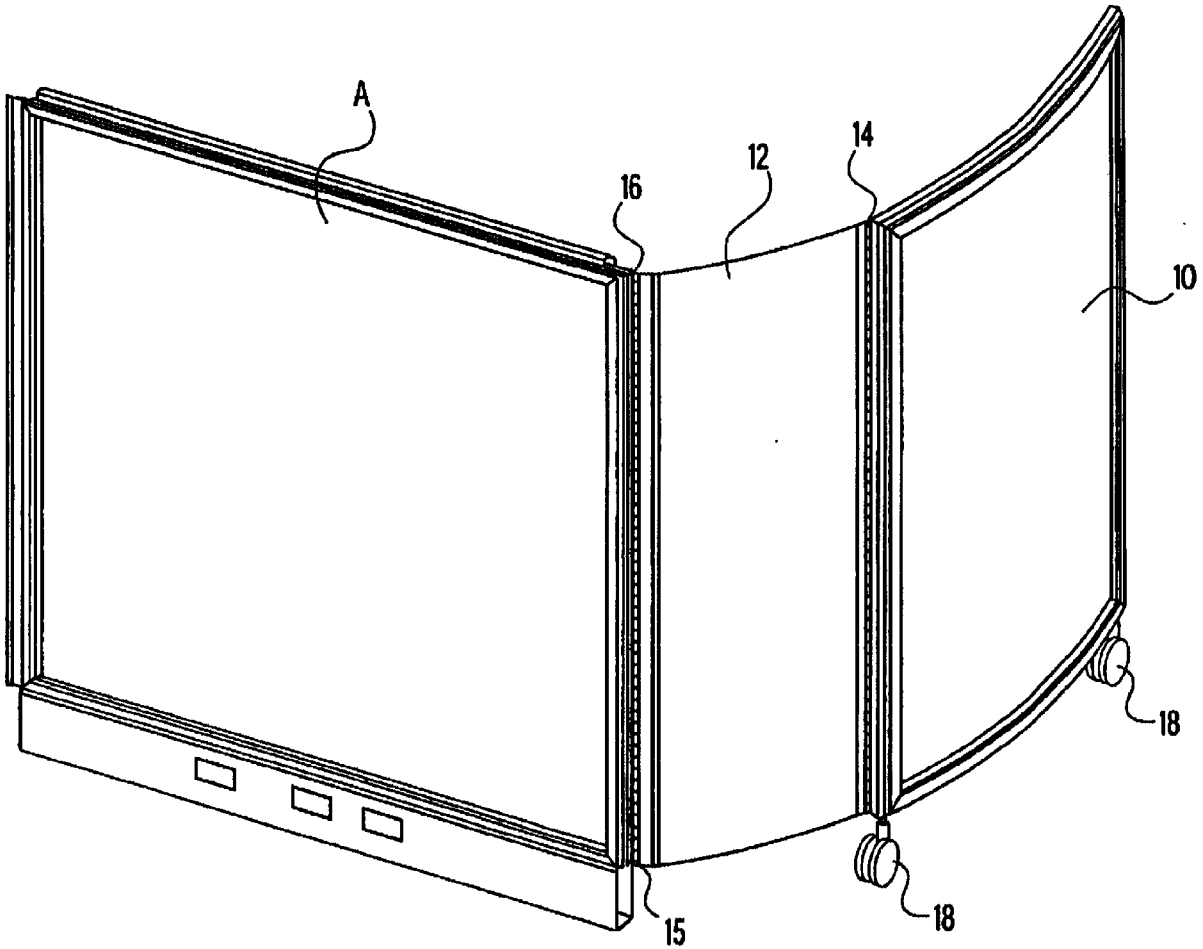
FIG. 3*a* shows a view of the door attached to the modular wall portion of the modular work space.
Figure 3B:
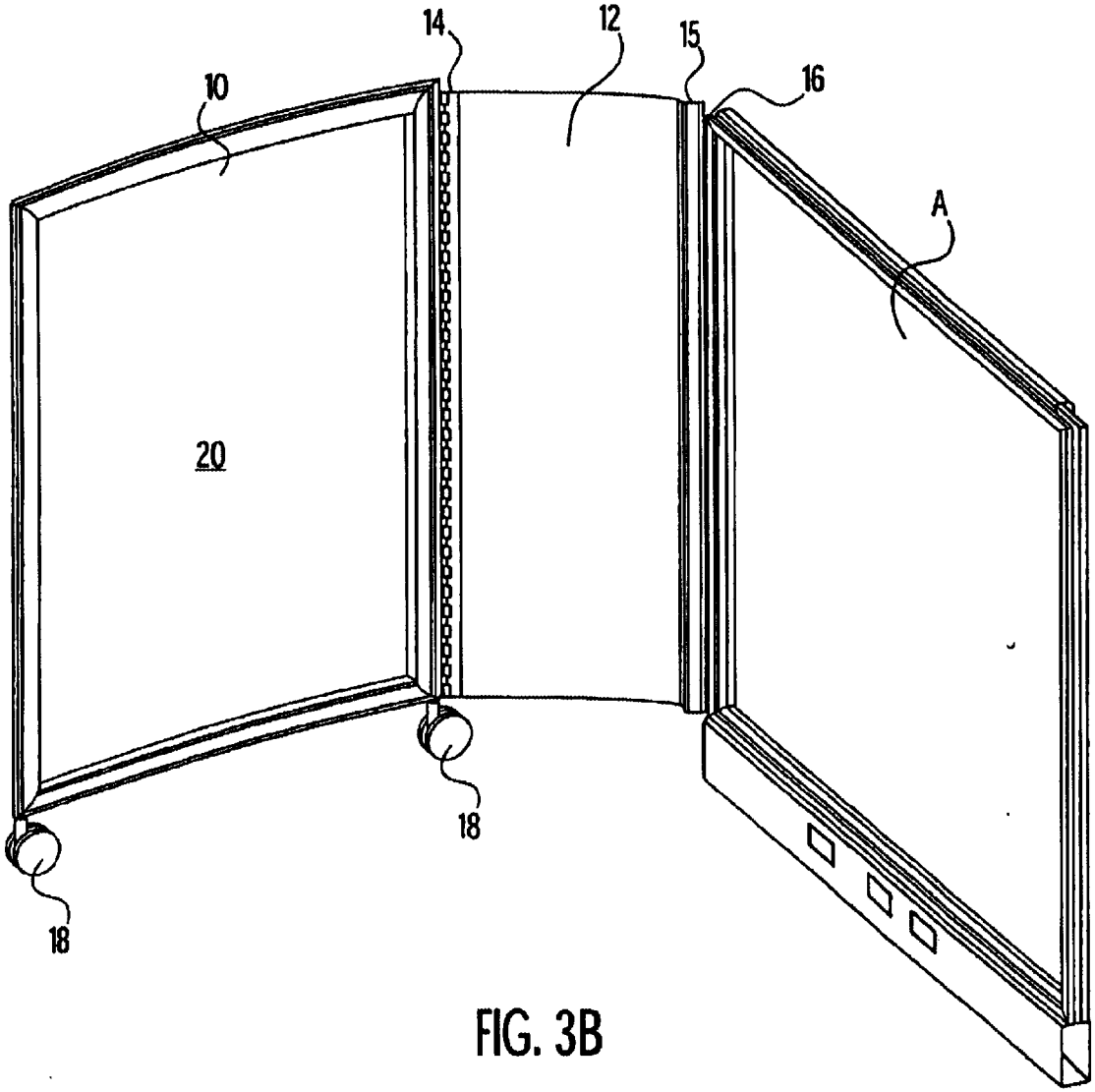
FIG. 3*b* is a reverse angle view of the door attached to the modular wall of FIG. 3*a*.

FIG. 1 shows the entire door of the present invention, which includes the following component parts. Main door portion 10 is composed of upper and lower frame members 22 and left and right side members 24. The framing members 22 and 24 frame insert 20. Casters 18 are attached to the bottom of lower framing members 22. Attached to one side member 24 is continuous hinge 14. Continuous hinge 14 is also attached to secondary panel 12 such that main panel 10 and secondary panel 12 may rotate with respect to each other about hinge 14. Attached to the other side of secondary panel 12 is a second continuous hinge 15 which provides the attachment point for attachment to an existing wall or modular office panel A, as shown in FIGS. 3*a* and 3*b*. Flat attachment panel 16, shown in FIG. 8, may be used to finish the end of wall A of the modular work space area to allow attachment of the door thereto.

Main door portion 10 may be of any general shape, such as flat or arcuate, as desired for manufacturing considerations or for cosmetic reasons. The figures used herein show exemplars of a door having arcuately-shaped main panel 10 and arcuately-shaped secondary panel 12, however, the invention is not meant to be limited thereby. To provide main panel 10 with an arcuate shape, upper and lower framing members 22 are arcuately shaped.

Figure 2:
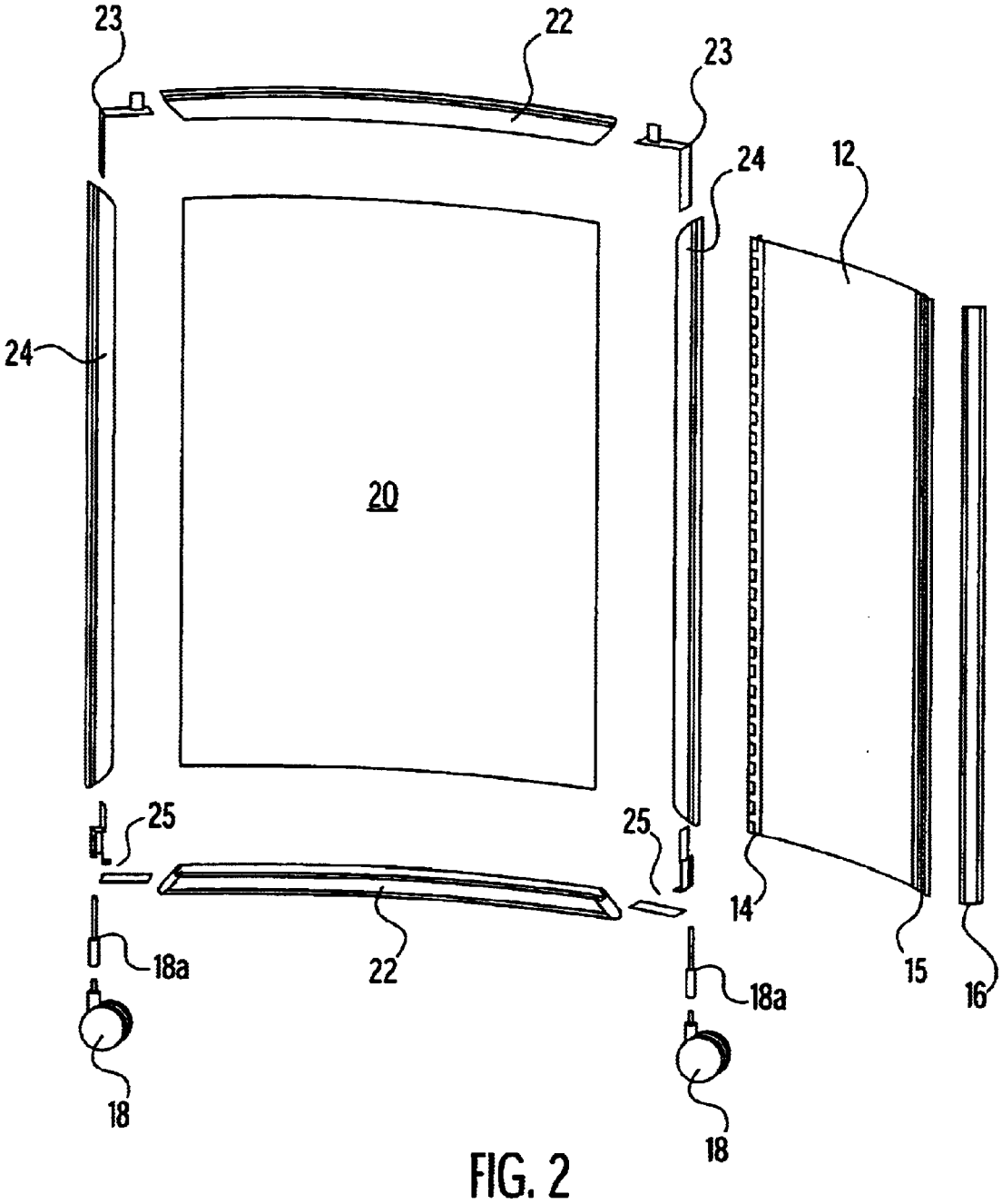
FIG. 2 shows an exploded view of the door of FIG. 1.

FIG. 2 shows the door in exploded view. Upper frame member 22 is attached to side frame members 24 with attachment members 23. Lower frame member 22 is attached to side frame members 24 using attachment members 25 which also serve to receive caster inserts 18*a* into which casters 18 are mounted.

Figure 6A:
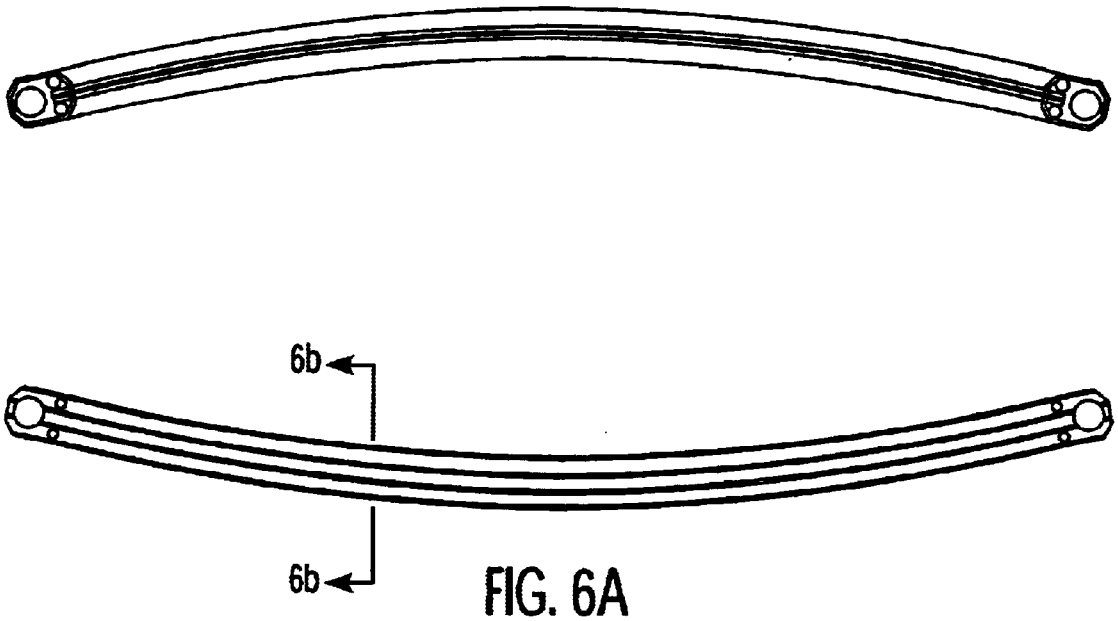
FIGS. 6*a* and 6*b* show the top and bottom frame members of the main door member.

FIGS. 3*a* and 3*b* show the door as attached to wall A of a modular office space. Main door portion 10, in this example, is arcuate in shape, as is secondary panel 12. In this embodiment, the degree of curvature of secondary panel 12 is less than that of main door portion 10. The arcuate shape of frame member 22 can be seen in FIG. 6*a*, and is shown in cross-section in FIG. 6*b*.

Figure 5A:
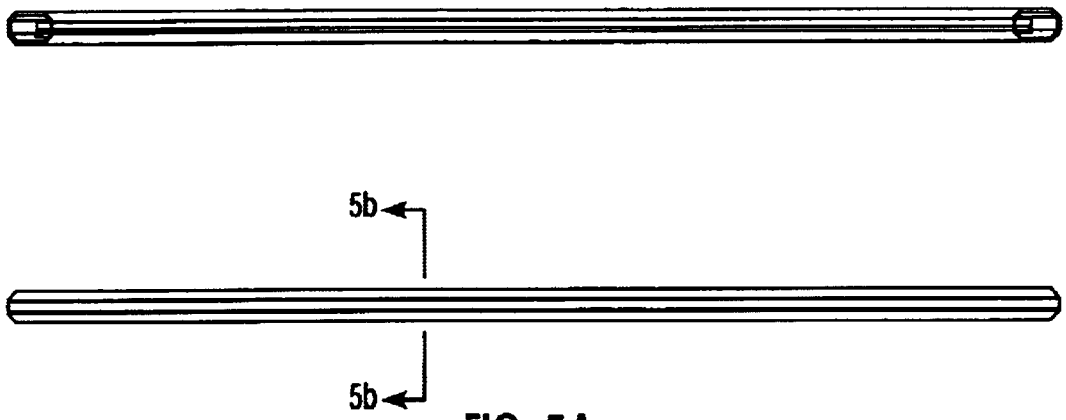
FIGS. 5*a* and 5*b* show the side frame members of the main door member.
Figure 5B:
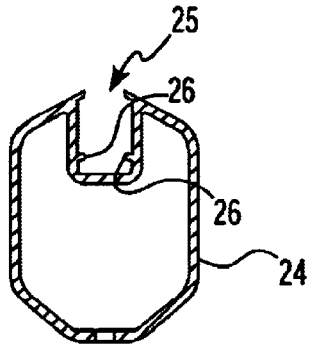
Figure 6B:
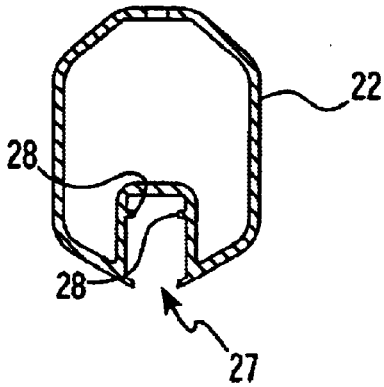

As can be seen in FIG. 6*b*, frame members 22 include slot 27 for receiving main door panel insert 20 which is held in place by protrusions 28 on the inner surface of slot 27. Likewise, as shown in FIGS. 5*a* and 5*b*, side frame members 24 have a similar slot 25 having protrusions 26 for receiving the edge of insert 20. Preferably, frame members 22 and 24 are composed of an extruded aluminum tubing, however, any other rigid material, such as fabricated metal, molded plastic or wood could be used. Frame members 22 and 24 may be of any general shape and are not meant to be limited to the shape shown in the figures.

Panel insert 20 is held in place by the frame formed by framing members 22 and 24 and is held in slots 25 and 27 respectively. Preferably, panel insert 20 is flexible and may be composed of any one of polycarbonate, perforated steel, wood or rigid or semi-rigid plastic, although any rigid or semi-rigid material which provides a visual and/or acoustic barrier, may be used, depending upon the amount of privacy desired for the interior of the modular office space.

Figure 7B:
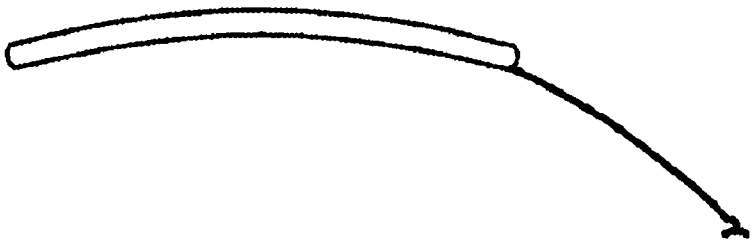
FIGS. 7*a* and 7*b* show a top view of the right-hand and left-hand versions of the door.
Figure 7A:
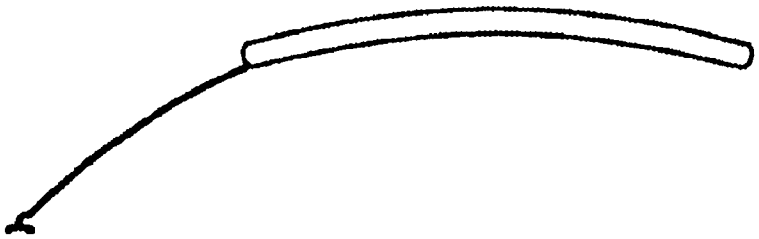

As shown in FIGS. 7*a* and 7*b*, the door can be made in both left and right hand versions, for use depending upon the configuration of the work space area, and both configurations are contemplated to be within the scope of the invention.

Figure 8:
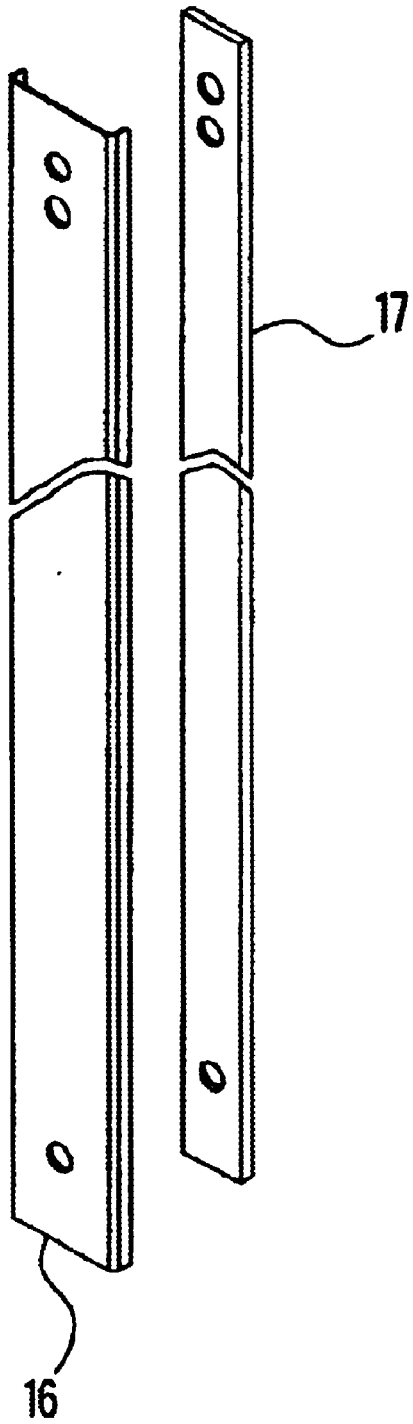
FIG. 8 shows the finishing member for a modular wall on which the door could be mounted.

FIG. 8 shows the flat finishing panel 16 which may be used to attach the door to the end portion of an existing modular work space wall A. Finishing panel 16 is preferably substantially U-shaped in cross section, but any material capable of supporting the door may be used. Spacing insert 17 can be used to assist in the fitting of flat finishing panel 16 to the end of modular work space wall A. Both finishing panel 16 and spacing insert 17 are preferably comprised of heavy-gauge steel, but any rigid material capable of supporting the door may be used. In particular, spacing insert 17 may be, for example, composed of plastic. Finishing panel 16 serves to provide a flat area at the end of modular wall A onto which the door can be mounted. To mount the door to finishing panel 16, or any other flat surface, continuous hinge 15 is attached via any commonly known means, such as with screws or by welding, to the flat surface.

Main door panel 10 is attached to secondary panel 12 via a continuous hinge 14 which is attached, preferably by welding, to one of frame members 24 and panel 12. Preferably, panel 12 is composed of heavy-gauge steel to provide structural integrity to the overall door, however, stainless steel, aluminum, plastic or any other rigid material could also be used. As previously stated, panel 12 is attached to modular work space wall A via a second continuous hinge 15 that is attached to both panel 12 and modular wall A via screws or any other well known attachment means, using finishing panel 16 and spacing insert 17, if necessary.

Figure 4A:
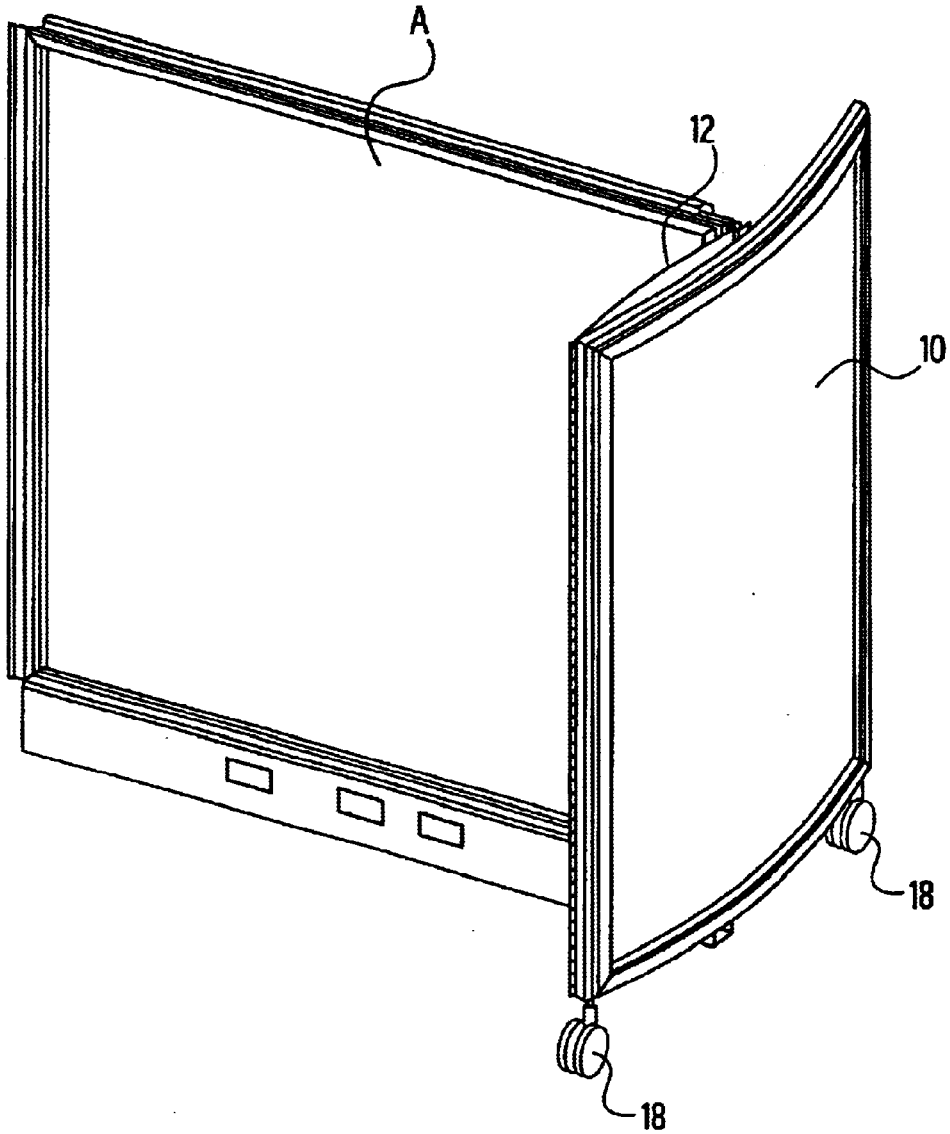
FIG. 4*a* is a view of the door in the folded up position against the modular wall.
Figure 4B:
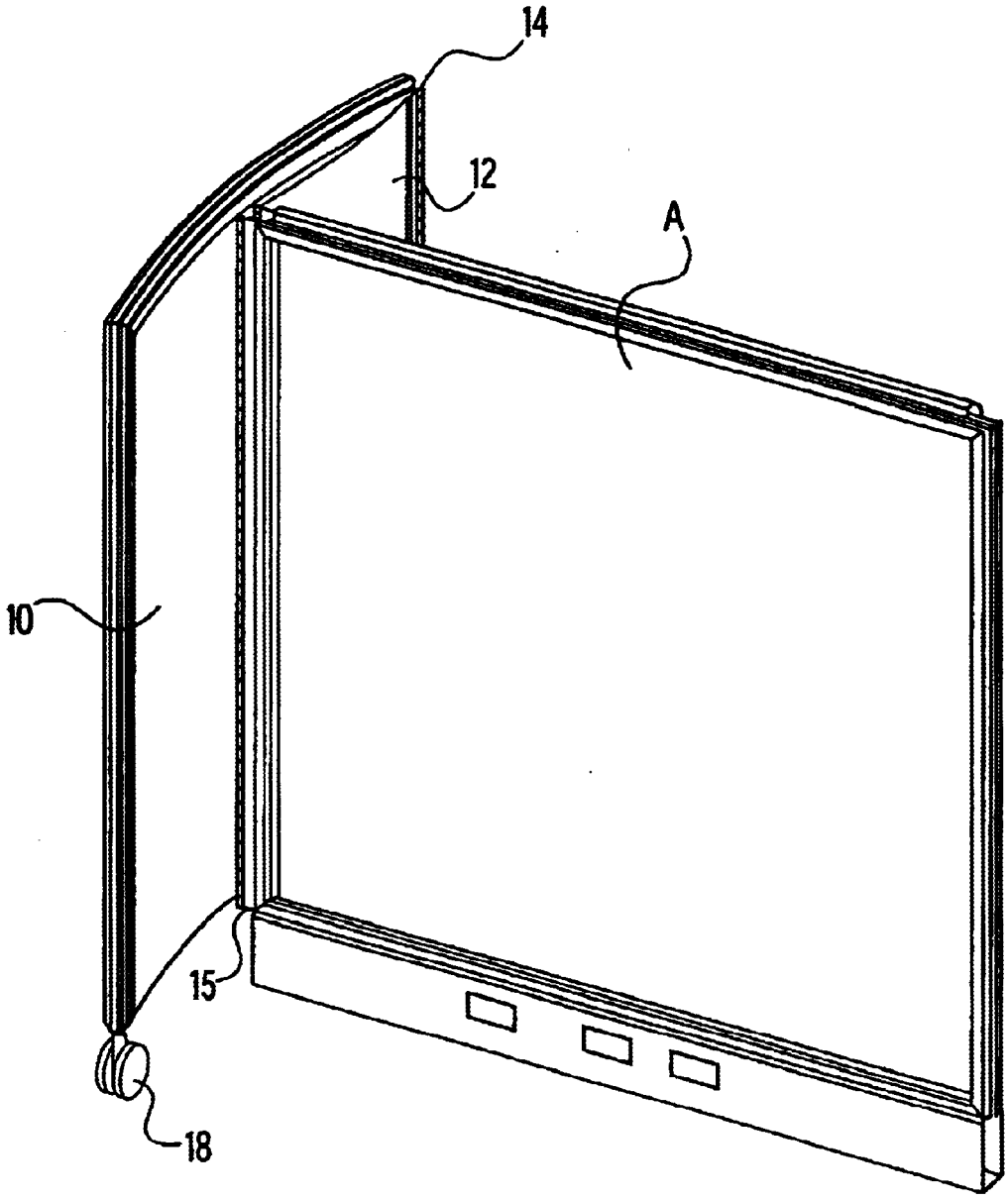
FIG. 4*b* is a reverse angle view of the door in the folded up position of FIG. 4*a*.
Figure 9:
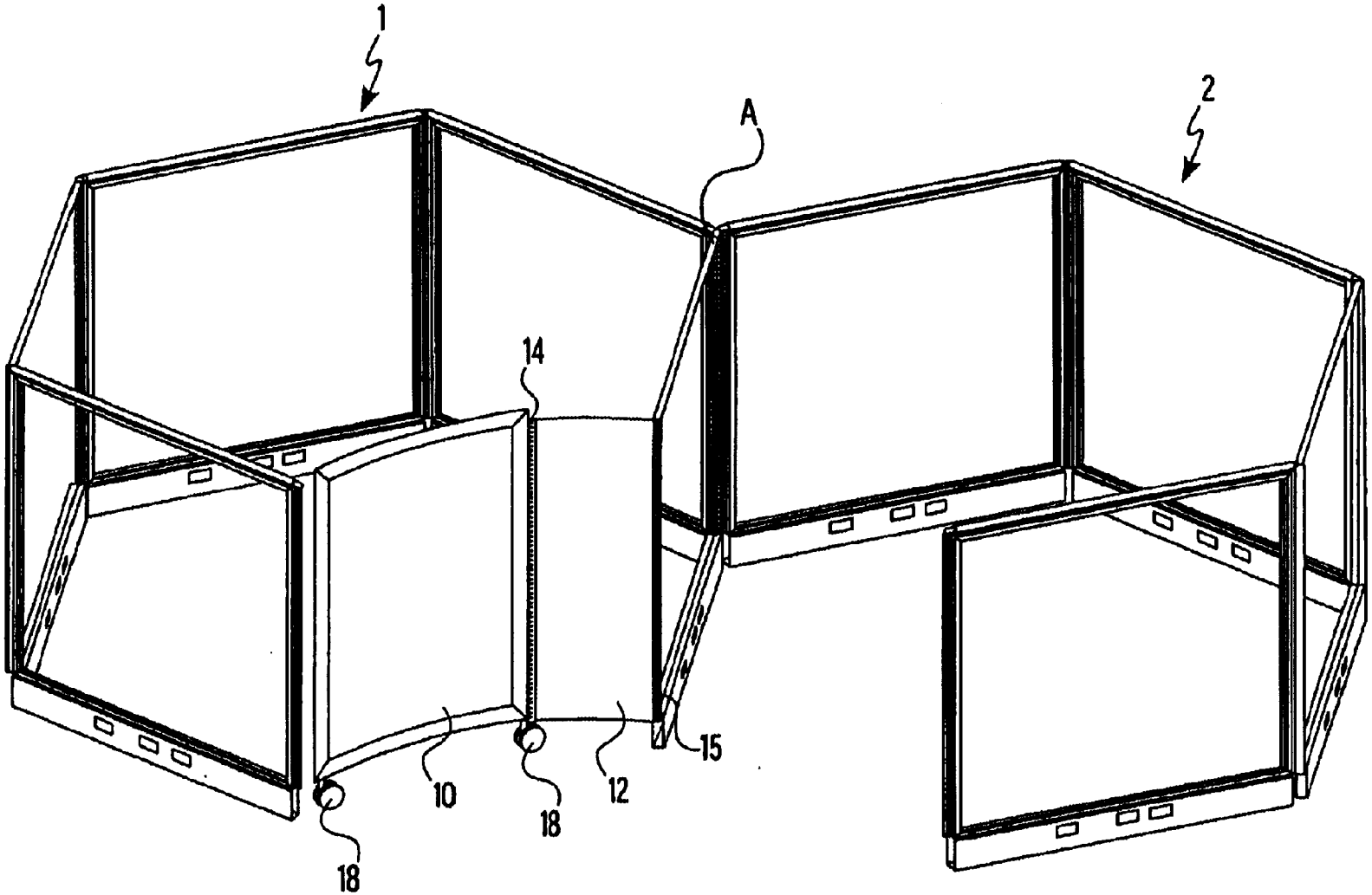
FIG. 9 is a view of two adjacent modular work spaces showing the door closing the entry and egress area of one of the spaces.
Figure 10:
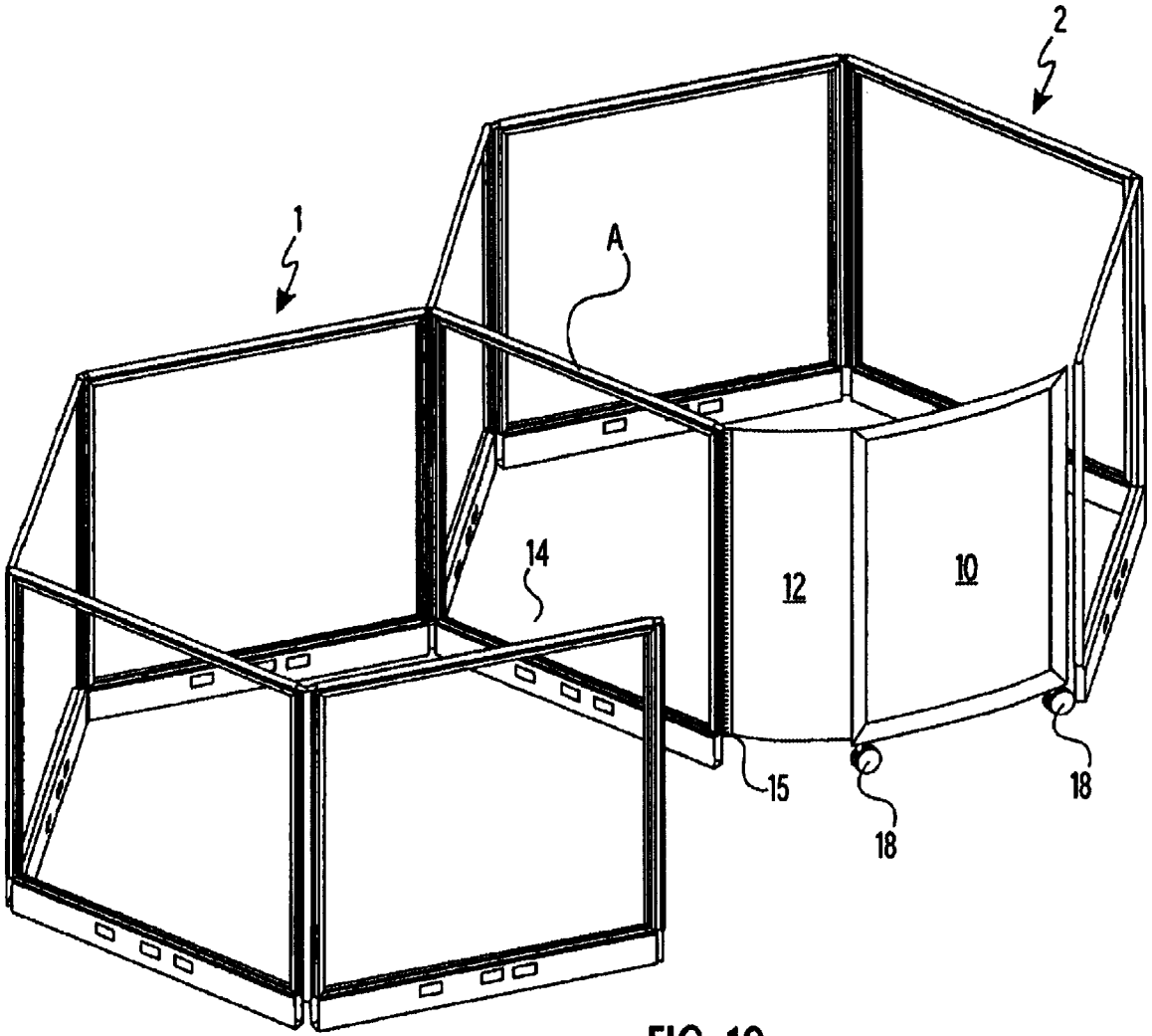
FIG. 10 is a second view of the two adjacent modular work spaces of FIG. 9 showing the door closing the entry and egress area of the other of the spaces.
Figure 11:
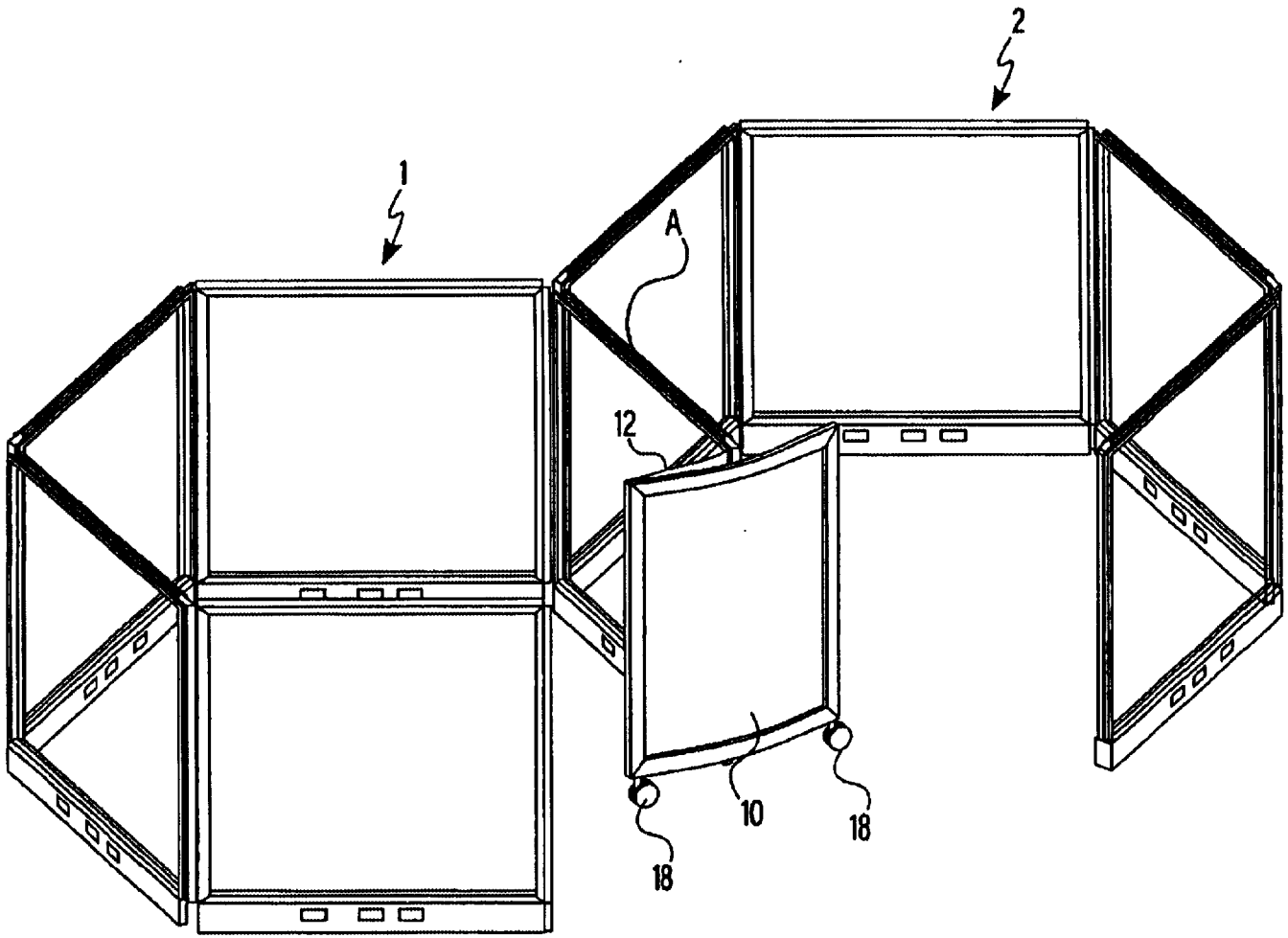
FIG. 11 is a third view of the two adjacent modular work spaces of FIG. 9 showing the door in an open, stowed position, allowing an open entry and egress area for both spaces.

FIGS. 9 and 10 show the door in place between two modular work space areas. In FIG. 9, work space area 1 is enclosed, while in FIG. 10, work space area 2 is enclosed. In operation, the door can swing between modular work space areas 1 or 2, or can be folded back as shown in FIGS. 4*a*, 4*b* and 11 into a position wherein entry and egress is enabled into both adjacent modular work space areas 1 and 2.

We claim:

1. A door comprising:

a first arcuately-shaped rigid panel;

a second arcuately-shaped rigid panel hingedly attached to said first rigid panel;

a plurality of casters, attached to the bottom of said second rigid panel; and an attachment member, connected to said first rigid panel, for attaching said door to a flat surface.

2. The door of claim 1 wherein said second rigid panel comprises:

a plurality of frame members forming a rectangular frame; and an insert held in said frame.

3. The door of claim 2 wherein said insert is a flexible panel.

4. The door of claim 3 wherein said flexible panel is composed of material selected from a group comprising polycarbonate, perforated steel and plastic.

5. The door of claim 2 wherein said frame members are composed of a material selected from a group comprising extruded aluminum, fabricated metal, molded plastic and wood.

6. The door of claim 1 wherein said first rigid panel is composed of a material selected from a group comprising steel, aluminum, stainless steel and plastic.

7. The door of claim 1 wherein said attachment member is a continuous hinge rigidly connected to said first rigid panel.

8. The door of claim 7 wherein said hinge has a plurality of holes is connected to said flat surface with a plurality of screws.

9. The door of claim 1 wherein said attachment member is a continuous hinge.

10. The door of claim 1 wherein said flat surface is a wall in a modular office workspace system.

11. In a modular office system having a plurality of modular workspace areas comprised of a plurality of modular walls, a door for closing one or more of said modular workspace areas comprising:

a first rigid panel;

a second rigid panel hingedly attached to said first rigid panel;

a plurality of casters, attached to the bottom of said second rigid panel; and an attachment member, connected to said first rigid panel, for attaching said door to one of said modular walls.

12. The door of claim 11 wherein said door is attached to one end of one of said modular walls.

13. The door of claim 12 further comprising a finishing panel for providing said wall where said door is attached with a flat surface to which said door is attached.

14. The door of claim 12 wherein said modular wall where said door is attached is shared between two adjacent modular workspace areas and further wherein said door can close either of said adjacent areas having said shared wall.

15. In a modular office system having a plurality of modular workspace areas comprised of a plurality of modular walls, an improvement comprising:

a door for closing one or more of said modular workspace areas, said door comprising:

a first rigid panel;

a second rigid panel hingedly attached to said first rigid panel;

a plurality of casters, attached to the bottom of said second rigid panel; and an attachment member, connected to said first rigid panel, for attaching said door to one of said modular walls;

wherein said wall where said door is attached is shared between two adjacent workspace areas and further wherein said door can close either of said adjacent workspace areas.

16. The improvement of claim 15 further comprising a finishing panel for providing said shared wall with a flat end section suitable for attaching said door.

17. The improvement of claim 15 wherein said second rigid panel comprises:

a plurality of frame members forming a rectangular frame; and an insert held in said frame.

18. The improvement of claim 17 herein said insert is a flexible panel.

19. The improvement of claim 18 wherein said flat panel is composed of material selected from a group comprising polycarbonate, perforated steel and plastic.

20. The improvement of claim 17 wherein said frame members are composed of a material selected from a group comprising extruded aluminum, fabricated metal, molded plastic and wood.

21. The improvement of claim 15 wherein said first rigid panel is composed of a material selected from a group comprising steel, aluminum, stainless steel and plastic.

22. The improvement of claim 21 wherein said first and second rigid panels are arcuate in shape.

23. The improvement of claim 15 wherein said attachment member is a continuous hinge rigidly connected to said first rigid panel.

24. The improvement of claim 16 wherein said hinge has a plurality of holes defined therein for connection to said finishing panel.

* * * * *

UNITED STATES PATENT AND TRADEMARK OFFICE

CERTIFICATE OF CORRECTION

PATENT NO. : 6,681,532 B1
DATED : January 27, 2004
INVENTOR(S) : Allen Lee Palmbos et al.

It is certified that error appears in the above-identified patent and that said Letters Patent is hereby corrected as shown below:

Column 4,
Lines 27-28, after "hinge", delete "has a plurality of holes".

Signed and Sealed this

Eleventh Day of May, 2004

JON W. DUDAS
*Acting Director of the United States Patent and Trademark Office*